US006446389B1

(12) United States Patent
Heffner et al.

(10) Patent No.: US 6,446,389 B1
(45) Date of Patent: Sep. 10, 2002

(54) TANDEM SLIDING DOOR OPERATOR

(75) Inventors: Steven P. Heffner, La Grange; Michael Manseau, Chicago, both of IL (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 09/550,241

(22) Filed: Apr. 14, 2000

(51) Int. Cl.[7] ..... E05F 15/06
(52) U.S. Cl. ..... 49/280; 49/118
(58) Field of Search ..... 49/118, 120, 280, 49/285, 293, 116, 295, 298, 300

(56) References Cited

U.S. PATENT DOCUMENTS 1,285,100 A * 11/1918 Forman ..... 91/42
1,300,782 A * 4/1919 Ryan ..... 49/18
2,003,399 A * 6/1935 Tamsitt ..... 187/319
3,343,302 A * 9/1967 Browning et al. ..... 49/18
3,455,058 A * 7/1969 Hewitt ..... 49/280
4,142,326 A * 3/1979 Schmitz ..... 49/118
4,364,454 A * 12/1982 Glaser et al. ..... 187/314
4,423,799 A * 1/1984 Glaser et al. ..... 187/314
4,901,474 A * 2/1990 Bayard et al. ..... 49/26
4,934,488 A * 6/1990 Umemurea ..... 187/335
5,070,575 A * 12/1991 Redman et al. ..... 16/96 R
5,139,112 A * 8/1992 Tonna et al. ..... 187/331
5,341,598 A * 8/1994 Reddy ..... 49/362
5,454,447 A * 10/1995 Kulak et al. ..... 187/331
5,669,465 A * 9/1997 Kulak et al. ..... 187/331
6,009,668 A * 1/2000 Reddy ..... 49/280
6,094,867 A * 8/2000 Reddy ..... 49/280
6,134,838 A * 10/2000 Reddy ..... 49/362

* cited by examiner

*Primary Examiner*—Gregory J. Strimbu
(74) *Attorney, Agent, or Firm*—James Ray & Associates

(57) ABSTRACT

Door operator for opening, closing and locking at least one door panel on a transit vehicle. The door operator has at least one base portion for mounting on the vehicle and at least one fixed support member attached to the base portion. The door operator has door hangers for attachment of the door panel to the fixed support member and moveable door support members attached to the door hangers. The moveable door support members engage the fixed support member to support the door panel while permitting opening and closing motions of the panel. The operator includes at least one door drive having a base mounted portion and a hanger mounted portion engaging the base mounted portion to be moved thereby to move the panel in opening and closing directions. The operator has a lock for securing the door panel in a closed position, the lock having a lock shaft which includes at least one primary lock device for preventing motion of the base mounted door drive portion and at least one secondary lock device engaging one of the door hangers. The lock includes a lock shaft engaging mechanism which rotates the lock shaft to a locking position when the door panel is closed. The lock also has an unlocking actuator for unlocking the door panel, the unlocking actuator having a moveable portion connected to the lock shaft to rotate the lock shaft to the unlocking position.

18 Claims, 12 Drawing Sheets

TANDEM SLIDING DOOR OPERATOR

CROSS REFERENCE TO RELATED APPLICATIONS

This application is related to the following patent and patent applications: U.S. Pat No. 3,745,705 for "INTEGRATED LINEAR DOOR OPERATOR"; U.S. patent application Ser. No. 08/804,779, filed on Feb. 24, 1997, for "DOOR DRIVE AND LOCK FOR MASS TRANSIT VEHICLE"; and U.S. provisional patent application Ser. No. 60/129,434. The teachings of the aforementioned patent, regular patent application and provisional patent application are incorporated herein by reference thereto.

FIELD OF THE INVENTION

The present invention relates, in general, to power door operators and, more particularly, this invention relates to power door operators of the type utilized in mass transit vehicles such as subway cars, transit buses, intra-urban trains, people movers and other mass transit vehicles.

BACKGROUND OF THE INVENTION

Power door operators are vital to maintain the scheduled operation of mass transit vehicles in that the reliable and rapid operation of doors is an absolute requirement in order to allow rapid passenger egress and exit. However, such door equipment must also countenance certain safety related requirements, including positive, defined panel movement, reliable panel locking and emergency panel release conveniently operable by passengers acting from inside the vehicle or by rescue personnel outside the vehicle.

A further requirement of modern day door drive equipment includes designs of a compact configuration suitable for mounting in locations overhead of the operated doors. Streamlined car design places great emphasis on a compact unit.

OBJECTS OF THE INVENTION

It is a primary object of the present invention to provide a reliable, compact overhead door drive for bi-parting doors for moving door panels to cover and uncover an opening in a vehicle side wall.

An additional object of the present invention is to provide a reliable, compact overhead door drive for bi-parting doors having a primary lock and also a direct panel lock.

It is a further object of the present invention to provide a compact, reliable overhead door drive for bi-parting door panels incorporating dual cable panel lock releases having independent capabilities providing panel movement for vehicle door opening which is easily operable by passengers inside the vehicle and others from outside the vehicle.

Still yet another object of the present invention is to provide a compact overhead door drive for bi-parting door panels wherein the direct door panel lock incorporates a gravity assist therein.

A further object of the present invention is to provide an overhead door drive utilizing dual helical drives operable by a single prime mover.

It is a further and additional object of the present invention to provide a compact overhead door drive for bi-parting doors wherein dual helical drives include sufficient flexibility to accommodate load induced camber in the vehicle structure.

Another object of the present invention is to provide a transit vehicle door equipped with redundant locking.

Yet another object of the present invention is to provide a transit vehicle door equipped with a redundant direct panel locking.

In addition to the various objects and advantages of the present invention which have been generally described above, there will be various other objects and advantages of the invention that will become more readily apparent to those persons who are skilled in the relevant art from the following more detailed description of the invention, particularly, when the detailed description is taken appended claims.

SUMMARY OF THE INVENTION

The present invention is a door operator for opening, closing and locking at least one door panel on a transit vehicle. It has at least one base portion for mounting on the transit vehicle and at least one fixed door support member attached to the base portion(s). It also has at least one door hanger for attachment of the door panel(s) and at least one moveable door support member attached to the door hanger (s). The moveable door support member(s) engage the fixed door support member(s) to support the door panel(s) while permitting motion of the door panel(s) in opening and closing direction(s) of the panel(s). The operator includes at least one door drive having at least one base mounted door drive portion and at least one hanger mounted door drive portion The hanger mounted door drive portion(s) engage the base mounted door drive portion(s) to be moved thereby and to cause the motion of the door panel(s) in opening direction(s) and in closing direction(s). The operator has a lock for securing the door panel(s) in closed position(s). The lock having a lock shaft substantially parallel to the opening direction(s) and the closing direction(s) of the door panel(s). The lock shaft includes at least one primary lock means for preventing motion of the base mounted door drive portion(s) and at least one secondary lock means engaging the door hanger(s) to prevent motion of the door hanger(s). The lock includes a lock shaft engaging means engaging the lock shaft to rotate the lock shaft from an unlocking position to a locking position when the door panel(s) are moved to the closed position(s) of the door panel(s). The lock also has an unlocking actuator for unlocking the door panel(s), the unlocking actuator having a moveable portion connected to the lock shaft to rotate the lock shaft to the unlocking position of the lock shaft.

DETAILED DESCRIPTION OF THE INVENTION

Figure 1:
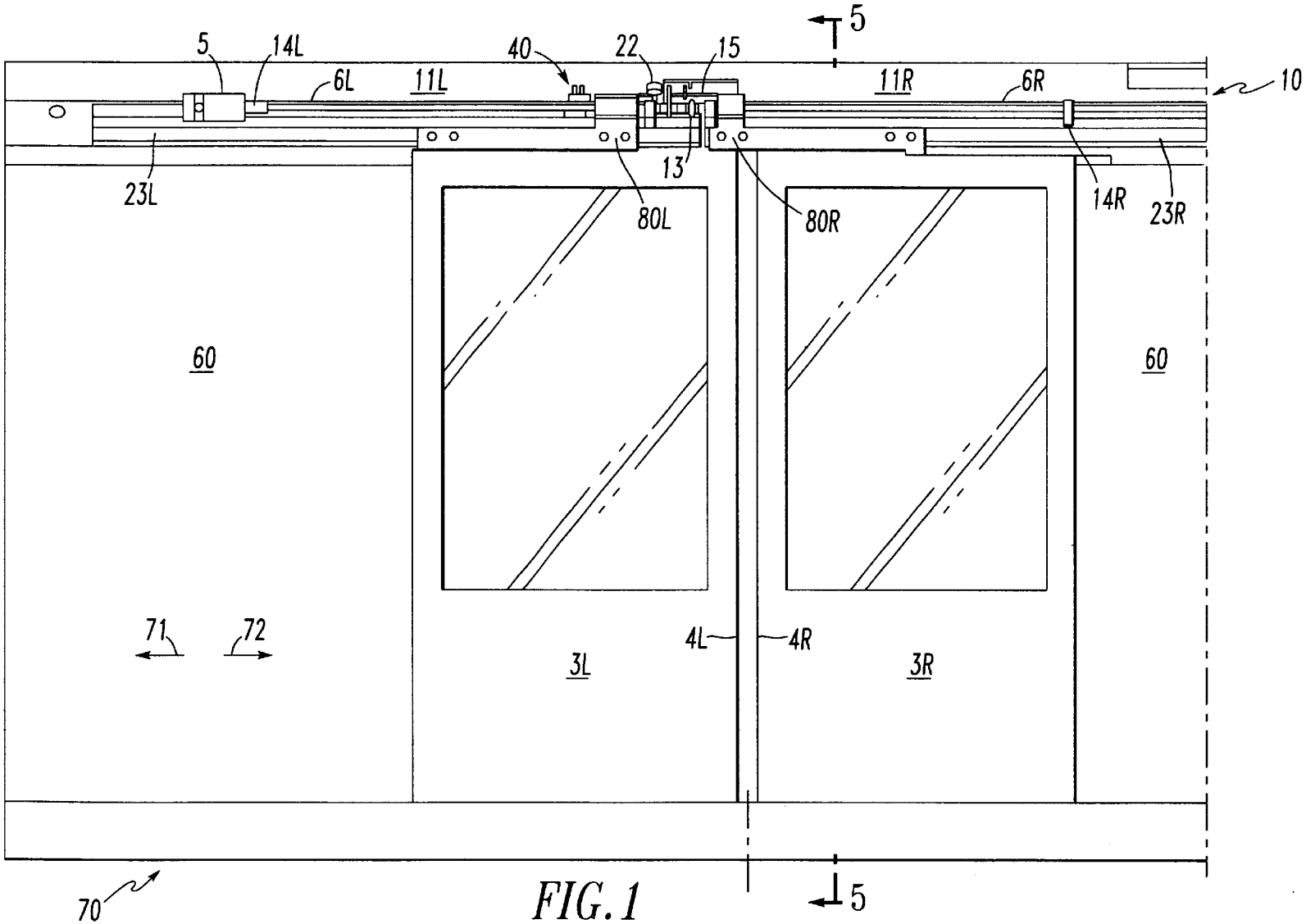
FIG. 1 is a side elevation view which illustrates one presently preferred embodiment of the door operator of the invention in situ as it is viewed from outside the vehicle, or car body, with a number of associated car body elements removed for clarity.

While the invention will be described as follows in connection with a presently preferred embodiment, it will be understood that it is not intended to limit the invention to that embodiment on the contrary, it is intended to cover all alternatives, modifications and equivalents as may be included within the spirit and scope of the invention as defined by the appended claims.

Prior to proceeding to the much more detailed description of the present invention, it should be noted that identical components which have identical functions have been identified with identical reference numerals throughout the several views illustrated in the drawing figures for the sake of clarity and understanding of the invention.

Figure 2:
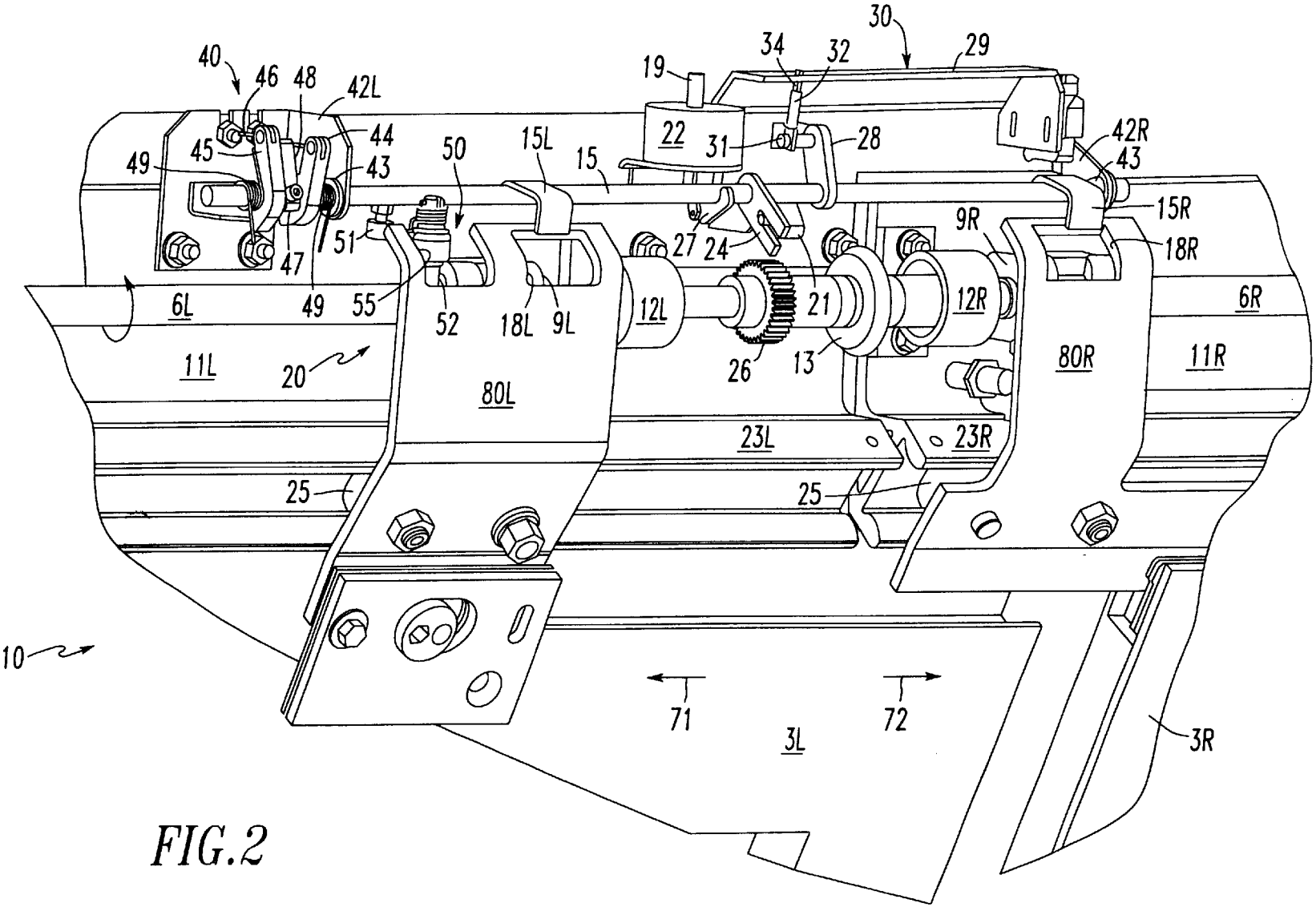
FIG. 2 is a partial perspective view of the door operator of the invention, as shown in FIG. 1, from outside of the associated vehicle, or car body, particularly showing the door panel drive system and lock with the door panels in a closed position and the door panel lock shaft rotated into a panel unlock condition.
Figure 3:
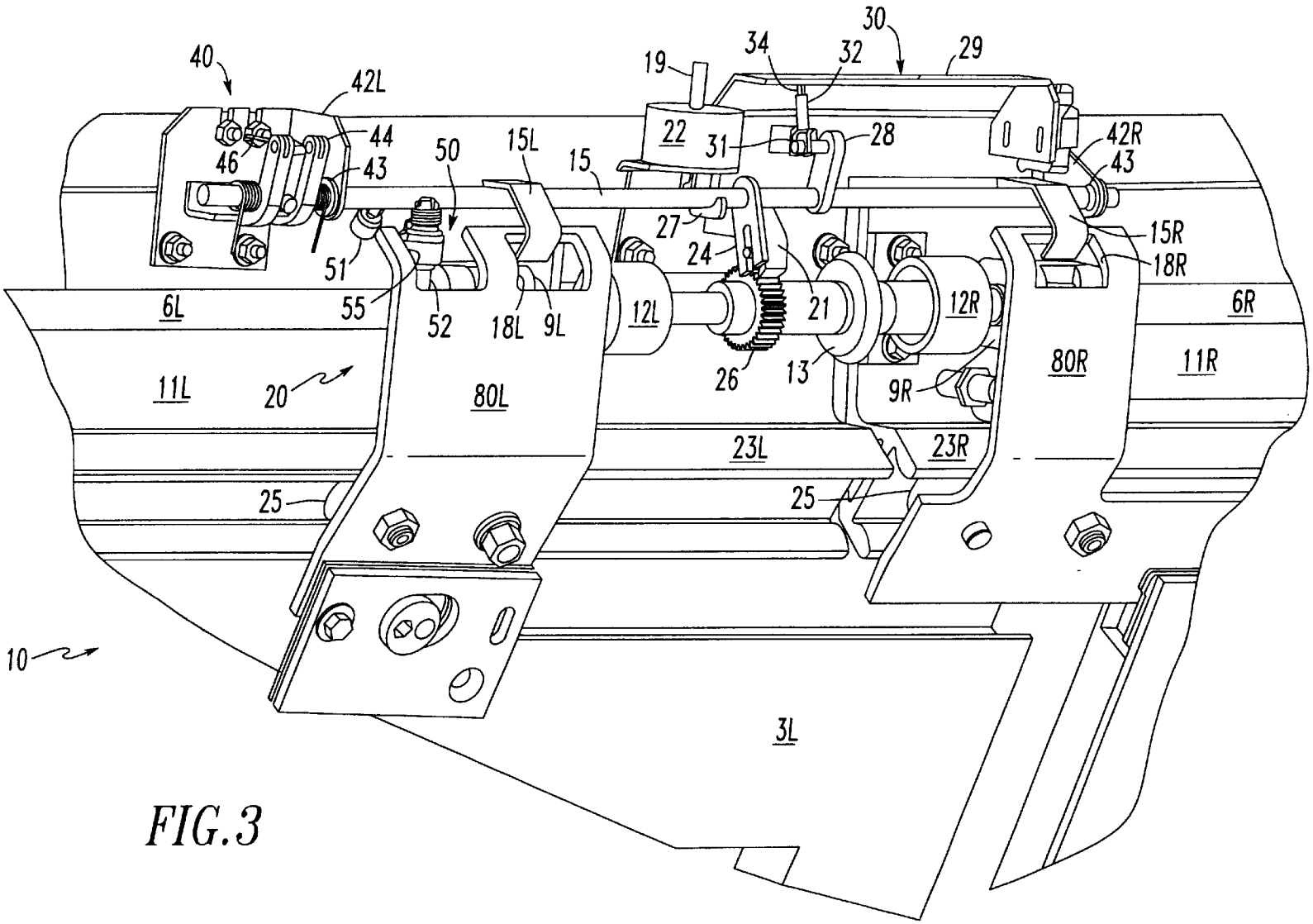
FIG. 3 is an additional partial perspective view of the door operator of the invention, as shown in FIGS. 1 and 2, from the outside of an associated car body, or vehicle, particularly showing the door panels in a fully closed position with the door lock shaft rotated into a panel lock position.

Attention is now directed to FIGS. 1–3 which illustrate a side wall 60 of a transit vehicle, generally designated 70. Transit vehicle 70 has a door operator, generally designated 10, for supporting and moving door panels 3L and 3R. The door operator 10, illustrated in these figures, is the presently preferred embodiment of the invention. Door operator 10 includes base portions 11L and 11R which enable attachment of the door operator to transit vehicle 70.

Door operator 10 moves door panels 3L and 3R in opposite directions during opening and closing strokes of door panels 3L and 3R. During an opening stroke, door operator 10 moves door panel 3L in direction 71 and it moves door panel 3R in an opposed direction 72. During a closing stroke, door panel 3L is moved in direction 72 and door panel 3R is moved in direction 71. Door panel 3L has an edge seal 4L which contacts an edge seal 4R of door panel 3R when door panels 3L and 3R are closed, as shown in FIG. 1.

Operator 10 has a motor 5 (FIG. 1) for opening and closing door panels 3L and 3R. Motor 5 is mounted on base portion 11L and is connected to rotate left drive screw 6L, which is connected by coupler 13 to right drive screw 6R, so that drive screws 6L and 6R rotate in the same direction at the same speed. Coupler 13 permits a misalignment between left drive screw 6L and right drive screw 6R. Misalignment may occur, for example, due to flexure of transit vehicle 70 due to a load of passengers. Drive screws 6L and 6R have opposite pitch to meet the requirement that door panels 3L and 3R move in opposite directions when drive screws 6L and 6R are rotated in the same direction by motor 5. Drive screws 6L and 6R are rotatably mounted on base portions 11L and 11R by journals 12L and 12R at their inner ends and by journals 14L and 14R (FIG. 1) at their outer ends, respectively.

Door support tracks 23L and 23R are attached to base portions 11L and 11R, respectively. Door panel 3L is supported by door hanger assembly 80L which is supported by rollers 25 (FIGS. 2 and 3) on track 23L. Door panel 3R is supported by door hanger assembly 80R which is supported by rollers 25 on track 23R.

FIGS. 2 and 3 show door operator 10 in unlocked and locked positions, respectively. When operator 10 is locked, as shown in FIG. 3, door panels 3L and 3R cannot be opened by forces on the door panels 3L and 3R.

Redundant locking of door panels 3L and 3R is provided by a lock mechanism, generally designated 20. Lock mechanism 20 includes lock shaft 15, which is rotatably attached to base portions 11L and 11R by journals 43 that are, in turn, attached to brackets 42L and 42R.

Lock shaft 15 is rotated from the unlocking position shown in FIG. 2 to the locking position shown in FIG. 3 by a mechanism to be discussed later when door panels 3L and 3R are closed. When lock shaft 15 is rotated to the locking position shown in FIG. 3, ratchet fork 24 moves ratchet pawl 21 to engage ratchet wheel 26 to prevent rotation of drive screw 6L. Since drive screw 6L is connected to drive screw 6R through coupler 13, this also prevents rotation of drive screw 6R. Immobilization of drive screws 6L and 6R prevents the movement of door panels 3L and 3R, thus providing primary locking door panels 3L and 3R.

Redundant locking of left door panel 3L is provided by lock pawl 15L which is attached to lock shaft 15. When lock shaft 15 rotates to the locking position shown in FIG. 3, lock pawl 15L enters lock aperture 18L in left door hanger 80L. This provides direct panel locking of left door hanger 80L and hence left door panel 3L.

Likewise, redundant locking of right door panel 3R is provided by lock pawl 15R which is also attached to the lock shaft 15. When lock shaft 15 rotates to the locking position shown in FIG. 3, lock pawl 15R enters lock aperture 18R in right door hanger 80R. This provides direct panel locking of right door hanger 80R and hence right door panel 3R.

Lock pawls 15L and 15R provide redundant locking of door panels 3L and 3R, even if the ratchet pawl 21 or ratchet wheel 26 were to fail.

Lock shaft 15 is maintained in either the unlocking position shown in FIG. 2 or the locking position shown in FIG. 3 by a lock shaft toggle assembly, generally designated 30. Toggle assembly 30 acts as an over center device that biases the lock shaft 15 to either the unlocking position or the locking position.

Lock shaft toggle assembly 30 includes a lock shaft arm 28 attached to lock shaft 15. Lock shaft arm 28 further includes a grooved pin 31 having a toggle retainer 34 rotatably attached thereto at one end. Toggle retainer 34 is also attached to a lock shaft toggle support bracket 29, as is shown in FIGS. 2 and 3.

Unlocking is normally accomplished by unlocking solenoid 22. Energization of solenoid 22 causes a downward movement of armature 19 which is connected to unlock arm 27 which is attached to lock shaft 15. Downward movement of unlock arm 27 causes lock shaft 15 to rotate from the locking position shown in FIG. 3 to the unlocking position shown in FIG. 2.

Figure 4:
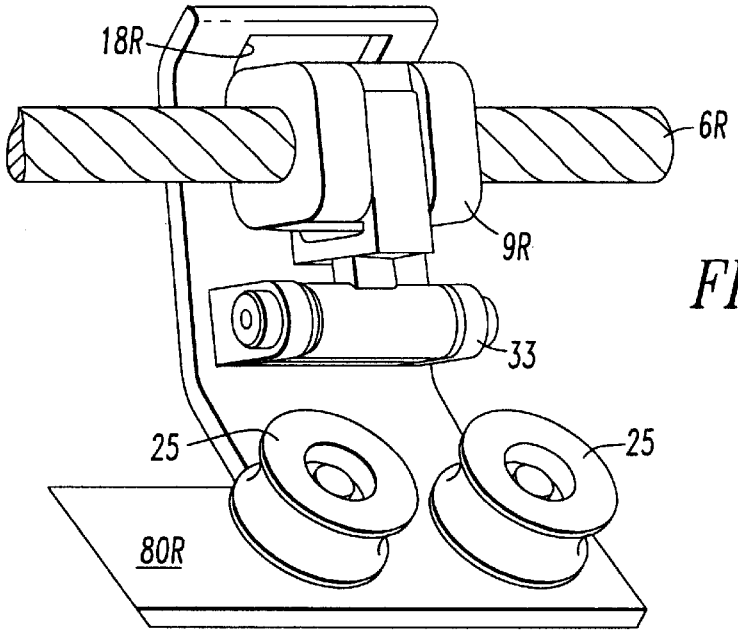
FIG. 4 is a perspective view of a portion of the door operator of the invention, more particularly, showing the door drive and associated drive nuts in cooperation with a door panel hanger.

FIG. 4 shows a drive nut 9R which engages drive screw 6R to be moved by rotation of drive screw 6R. Drive nut 9R is connected through pivot 33 to right hanger assembly 80R, so that door panel 3R is moved by drive nut 9R. Pivot 33 permits both displacement and misalignment of the drive screw 6R relative to track 23R. Such displacement or misalignment may be caused by the aforementioned flexure of transit vehicle 70 due to a load of passengers.

Likewise, door panel 3L is moved by drive nut 9L (seen in FIGS. 2 and 3). Drive nut 9L is mounted to left hanger assembly 80L in a manner similar to the mounting of drive nut 9R.

Figure 6:
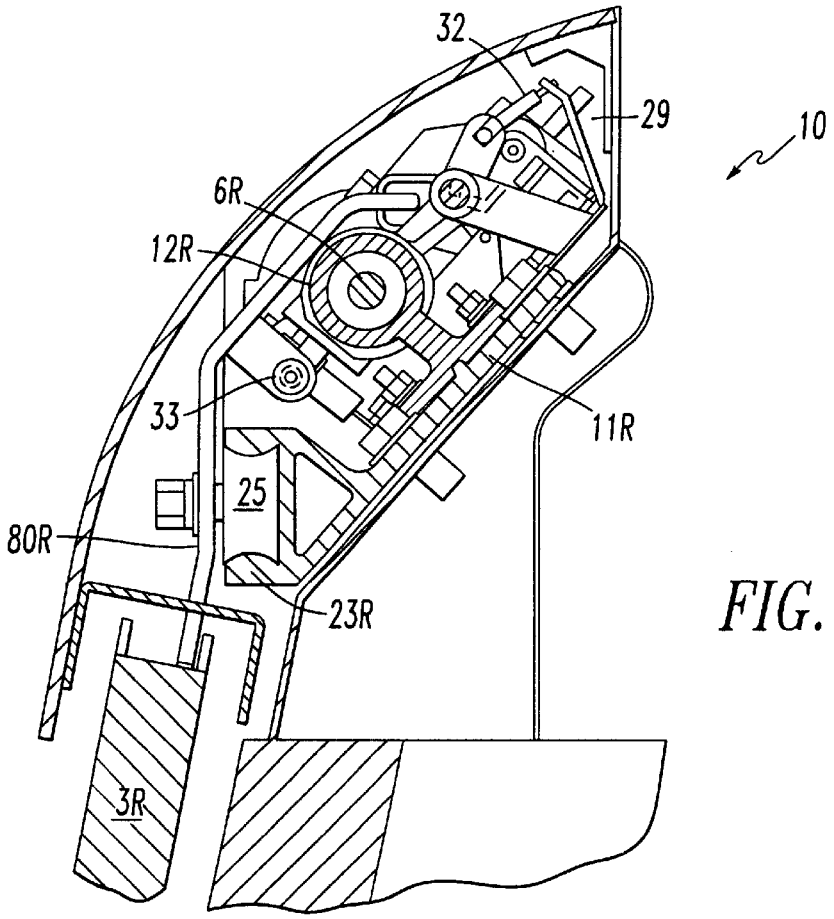
FIG. 6 is an enlarged view of a portion of the section shown in FIG. 5, particularly, showing components of the door drive system.
Figure 5:
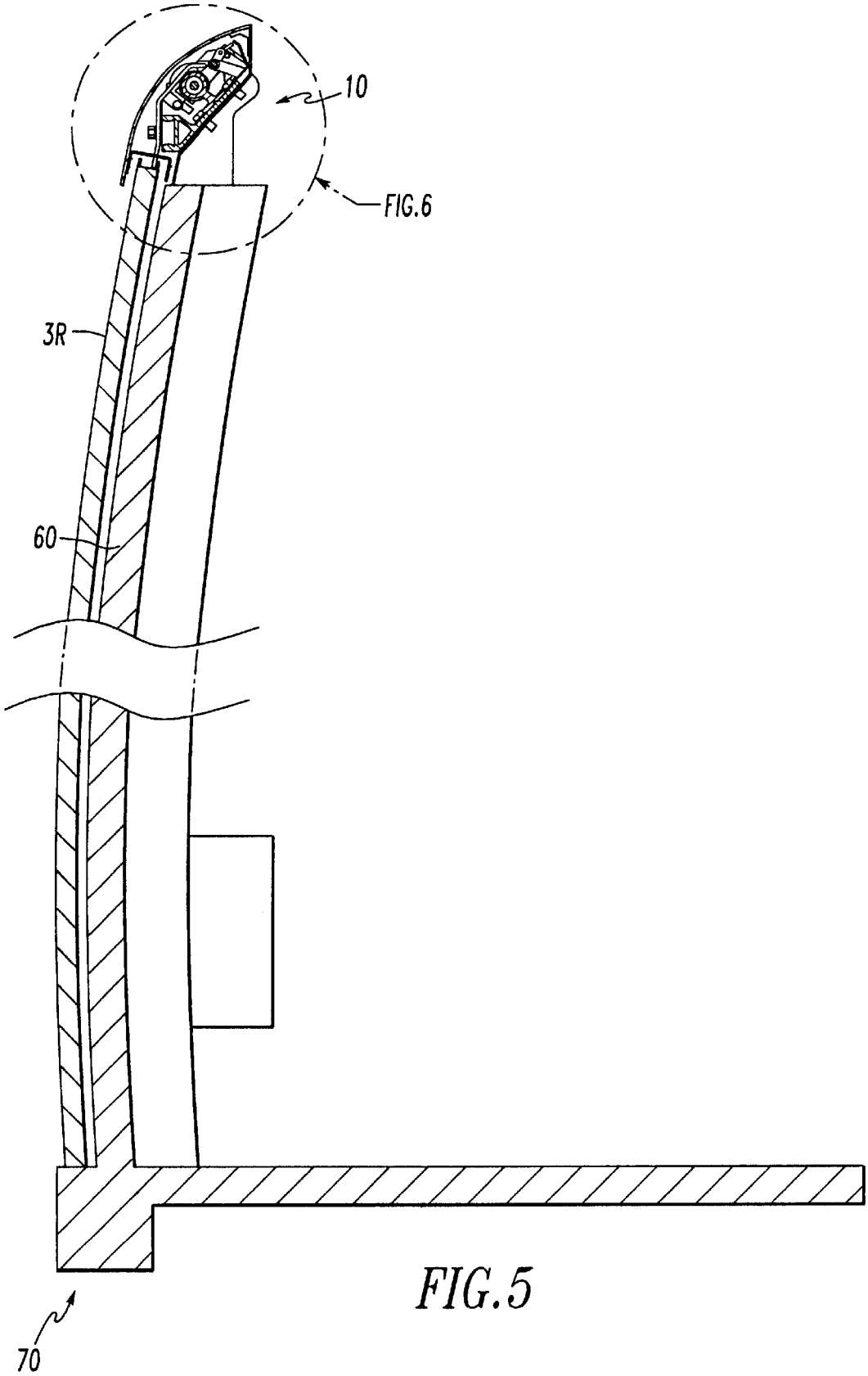
FIG. 5 is a partial section view of the door operator of the invention in place in a vehicle side wall, more particularly showing the sectional view of the door operator, taken along the section line 5—5 of FIG. 1.

Additional detail concerning operator 10 is provided in FIGS. 5 and 6, which are sections cut along section 5—5 in FIG. 1. These figures show door panel 3R suspended by right hanger assembly 80R which is supported by rollers 25 on track 23R on base portion 11R. These figures also show base portion 11R mounted on sidewall 60 of transit vehicle 70.

Lock shaft 15 is rotated from the unlocking position shown in FIG. 2 to the locking position shown in FIG. 3 by cooperation between lock roller 51 and a locking assembly, generally designated 50. FIGS. 7 to 15 illustrates three steps of the locking process.

Lock assembly 50 has a cylindrical portion 53 which is mounted on bracket 52 on left door hanger 80L. Lock assembly 50 includes a cam 62, rotatably mounted on cylindrical portion 53. A helical spring 54 biases cam 62 to the position shown in FIGS. 7, 8 and 9.

Figure 7:
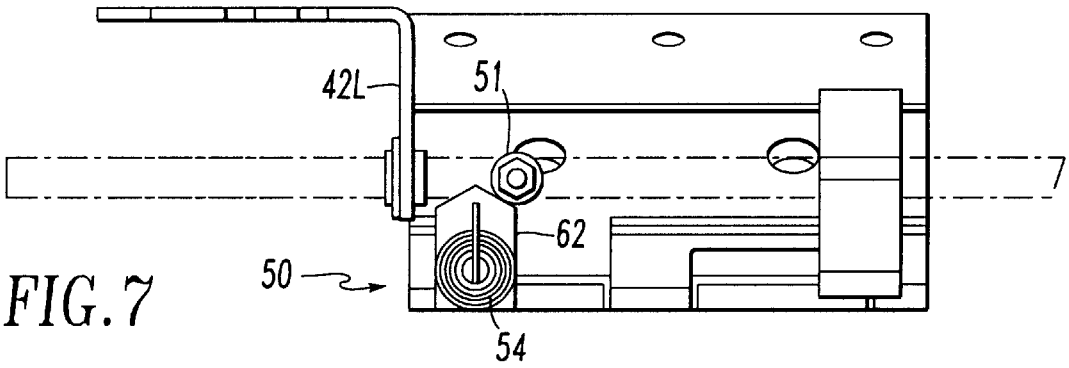
FIG. 7 is a top view of the door panel lock of the invention, particularly, showing the door panel during a closing stroke in which the lock cam has engaged the lock roller on the lock shaft to rotate the lock shaft toward a panel lock condition.
Figure 8:
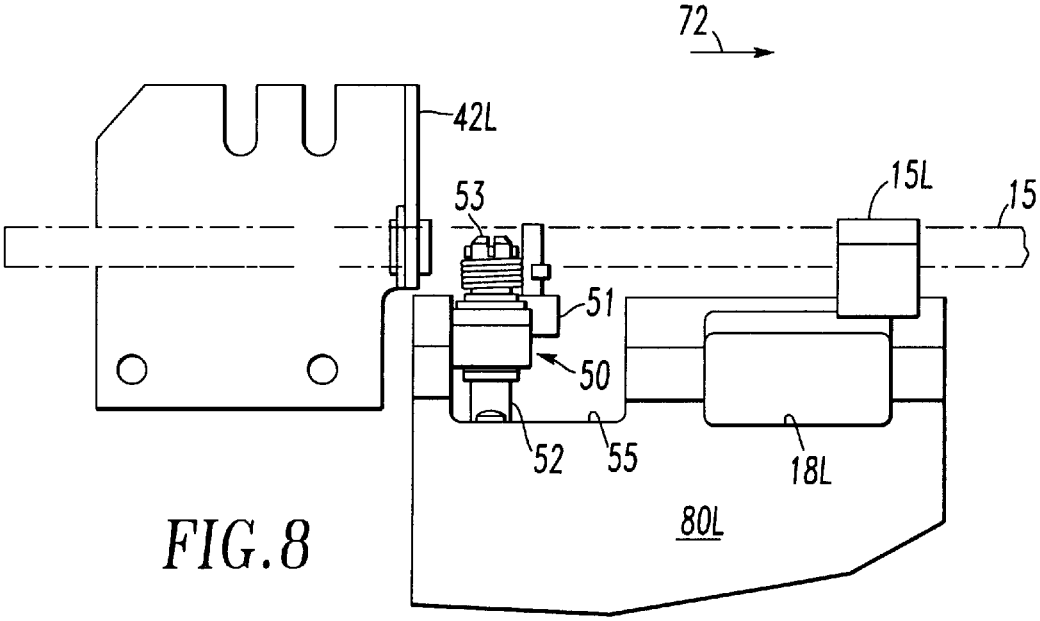
FIG. 8 is a front view of the door panel lock of the invention as shown in FIG. 7.
Figure 9:
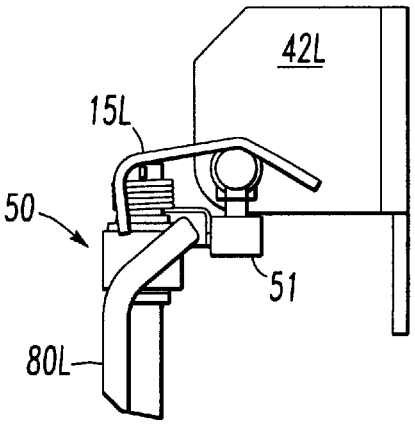
FIG. 9 is a side view of the door panel lock of the invention as shown in FIGS. 7 and 8.

When left door panel is moved in its closing direction 72, the cam 62 contacts lock roller 51 as illustrated in FIGS. 7, 8 and 9.

Figure 10:
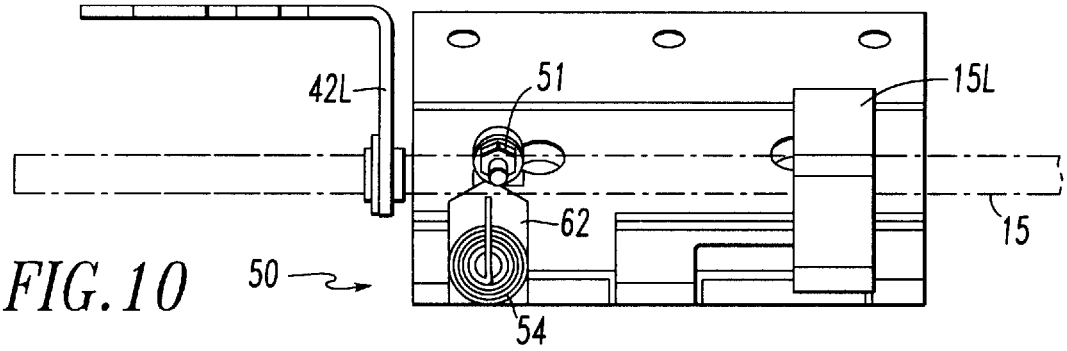
FIG. 10 is a top view of the door panel lock of the invention wherein the lock cam has engaged the lock roller and has begun rotating the lock shaft to the locking position.
Figure 11:
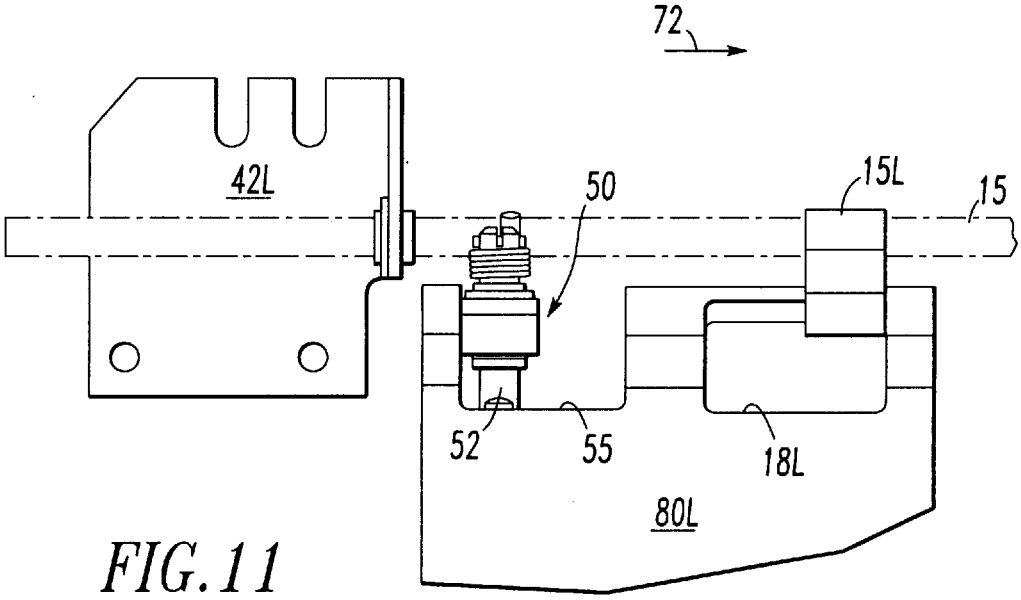
FIG. 11 is a front view of the lock of FIG. 10.
Figure 12:
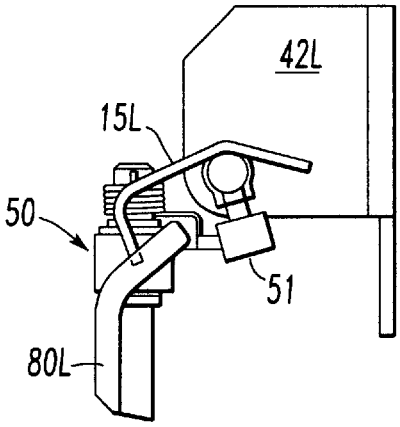
FIG. 12 is a side view of the lock of FIGS. 10 and 11.

Further movement in closing direction 72 causes cam 62 to begin rotating lock shaft 15 by cooperation with lock roller 51. FIGS. 10, 11 and 12 show lock shaft 15 rotated 15 degrees toward the locked position. FIGS. 11 and 12 show left lock pawl 15L beginning to enter left lock aperture 18L.

Figure 13:
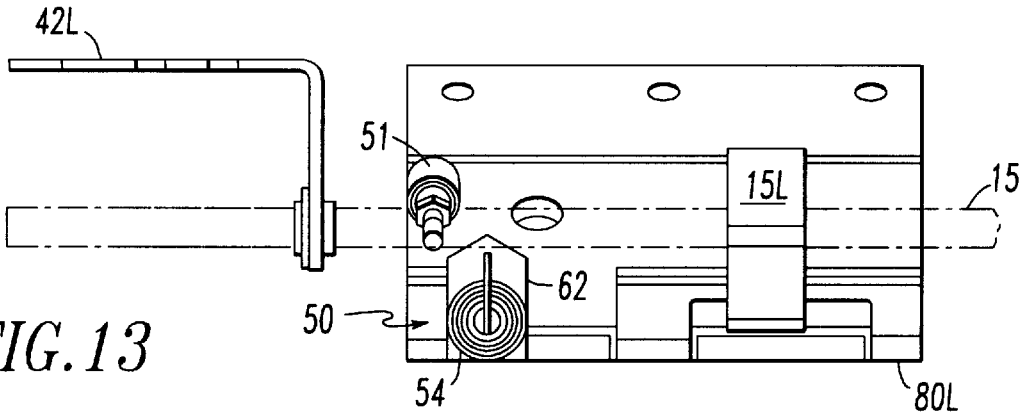
FIG. 13 is a top view of the door panel lock of the invention with the door panel in a closed and locked position.
Figure 14:
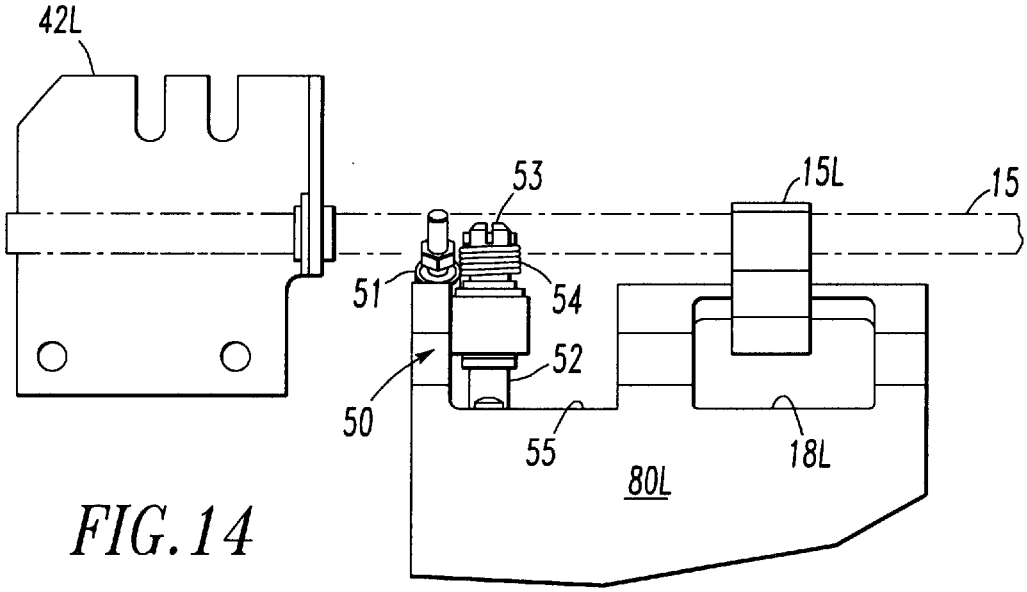
FIG. 14 is a front view of the lock of FIG. 13.
Figure 15:
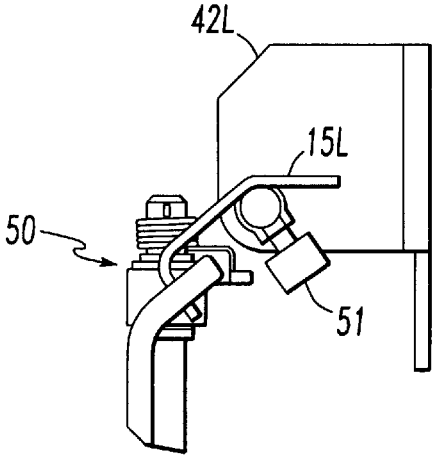
FIG. 15 is a side view of the lock of FIGS. 13 and 14.

FIGS. 13, 14 and 15 show lock shaft 15 rotated 30 degrees to the fully locked position shown. Left lock pawl 15L is positioned in left lock aperture 18L to prevent movement of left door hanger 80L and hence left door panel 3L. Likewise, in this position, the right lock pawl 15R has entered into right lock aperture 18R and ratchet pawl 21 has engaged ratchet wheel 26, as shown in FIG. 3. Lock shaft 15 is retained in the locking position shown by the lock shaft toggle assembly 30 and is also biased toward the locking position by gravity. It is preferred that the gravity moment due to lock pawls 15L and 15R plus the gravity moment of ratchet pawl 21 and ratchet fork 24 exceed the gravity moment due to the unlock arm 27 and armature 19.

Figure 16:
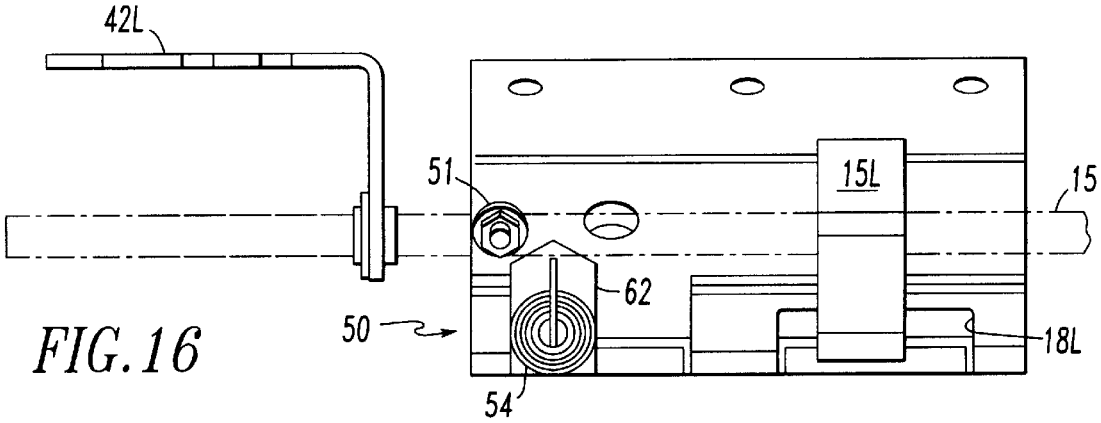
FIG. 16 is a top view of the lock for a panel closed condition after panel unlock by solenoid rotation of the door lock shaft.
Figure 17:
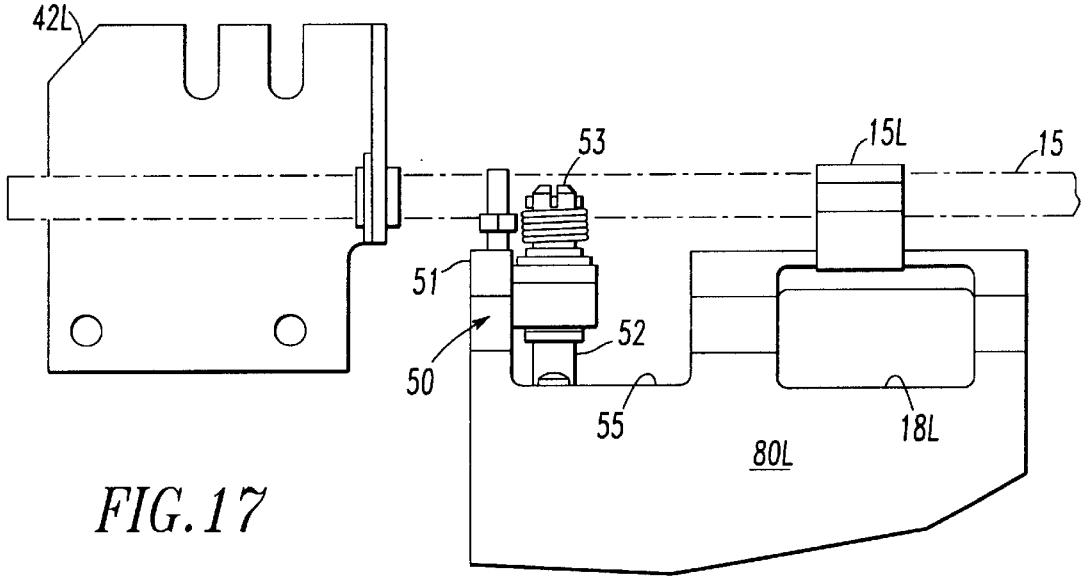
FIG. 17 is a front view of the door panel lock shown in FIG. 16.
Figure 18:
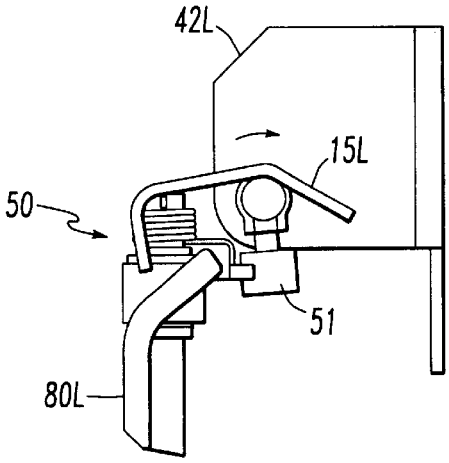
FIG. 18 is a side view of the door panel lock shown in FIGS. 16 and 17.

FIGS. 16, 17 and 18 illustrate the positions of the locking components 50 and 51 after an unlock signal has been sent to solenoid 22 (FIGS. 2 and 3). Energization of solenoid 22 causes armature 19 to move downward to rotate lock shaft 15 from the locking position shown in FIG. 3 to the unlocking position shown in FIG. 2. In FIGS. 16, 17 and 18, the door panels 3L and 3R are closed but fully unlocked.

Figure 19:
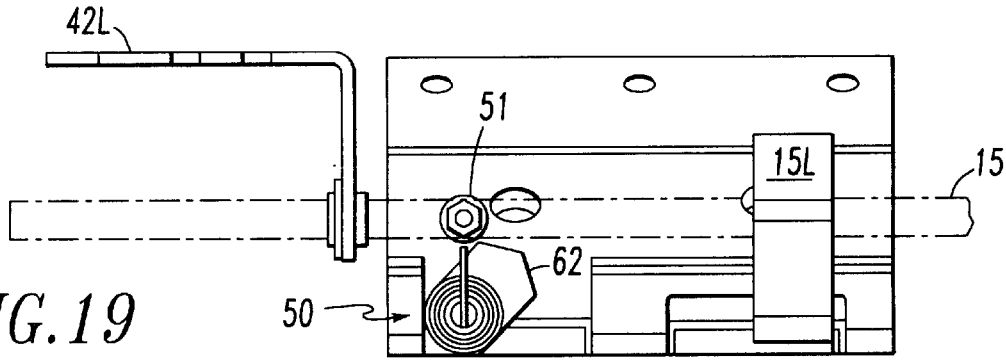
FIG. 19 is a top view of the door panel lock of the invention at the beginning of an opening stroke after solenoid unlock, the lock cam being rotated to bypass the lock roller.
Figure 20:
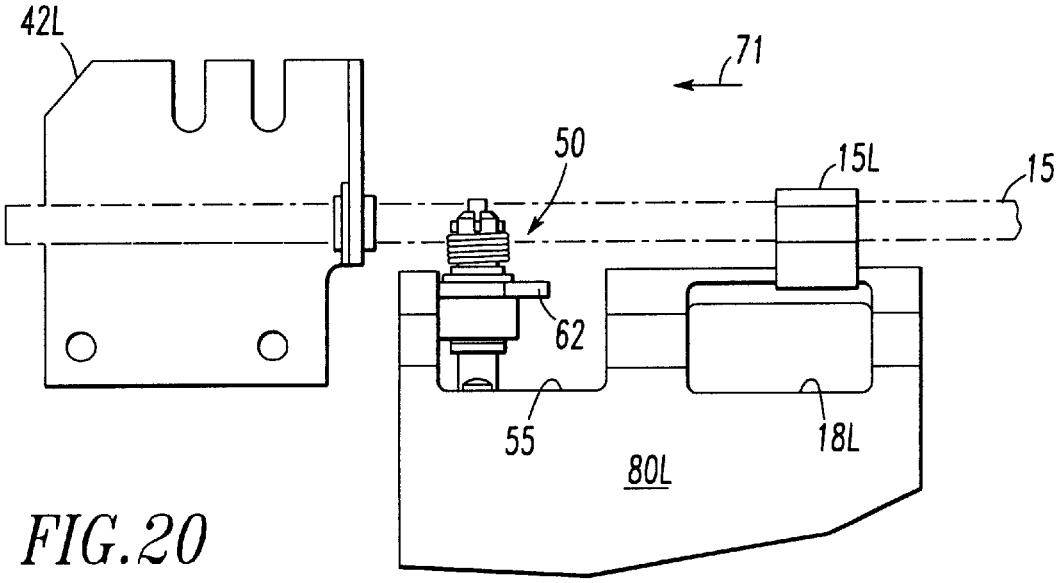
FIG. 20 is a front view of the door panel lock of FIG. 19.
Figure 21:
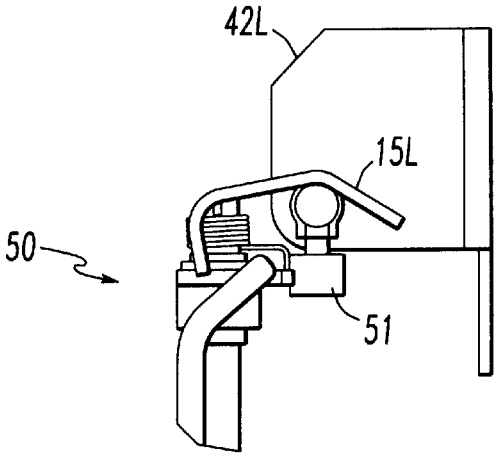
FIG. 21 is a side view of the door panel lock of FIGS. 19 and 20.

FIGS. 19, 20 and 21 illustrate the positions of the locking components 50 and 51 after left door hanger 80L and hence left door panel 3L have begun to move in opening direction 71. Cam 62 has contacted lock roller 51 and has been rotated to the position shown in FIG. 19. Cam 62 is rotated to the position shown so it can pass the lock roller 51 without forcing lock roller 51 back into the locking position.

Figure 22:
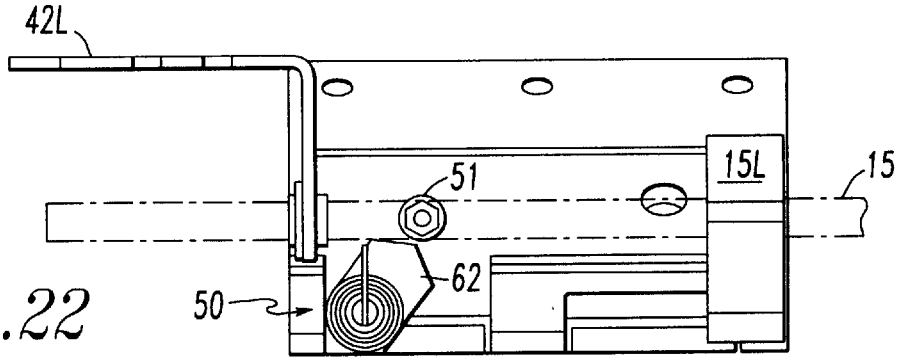
FIG. 22 is an additional top view of the door panel lock of the invention, particularly showing the lock in a panel unlock condition after the door panel has moved in an opening direction, the lock cam being almost clear of the lock roller.
Figure 23:
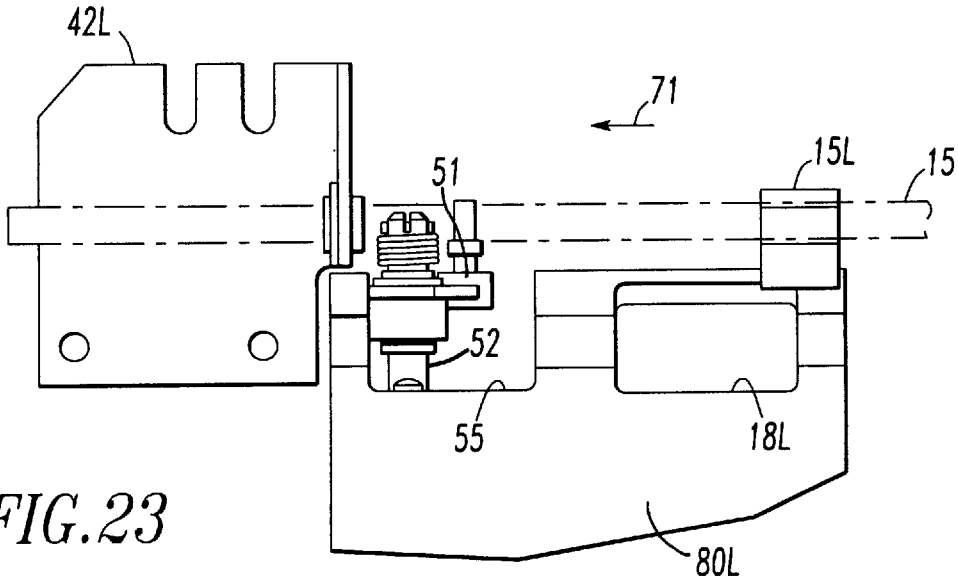
FIG. 23 is a front view of the door lock of FIG. 22.
Figure 24:
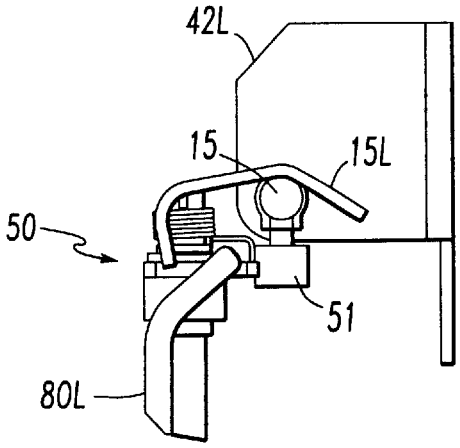
FIG. 24 is a side view of the door lock of FIGS. 22 and 23.

FIGS. 22, 23 and 24 illustrate the positions of the locking components 50 and 51 after left door hanger 80L has moved further in opening direction 71. In these figures, lock cam 62 has almost passed lock roller 51.

Figure 25:
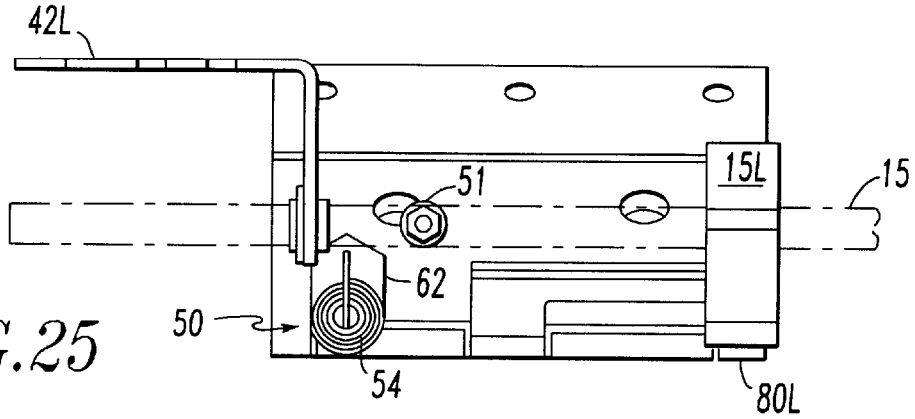
FIG. 25 is a top view of the door panel lock of the invention, particularly showing the lock cam in its reset position.
Figure 26:
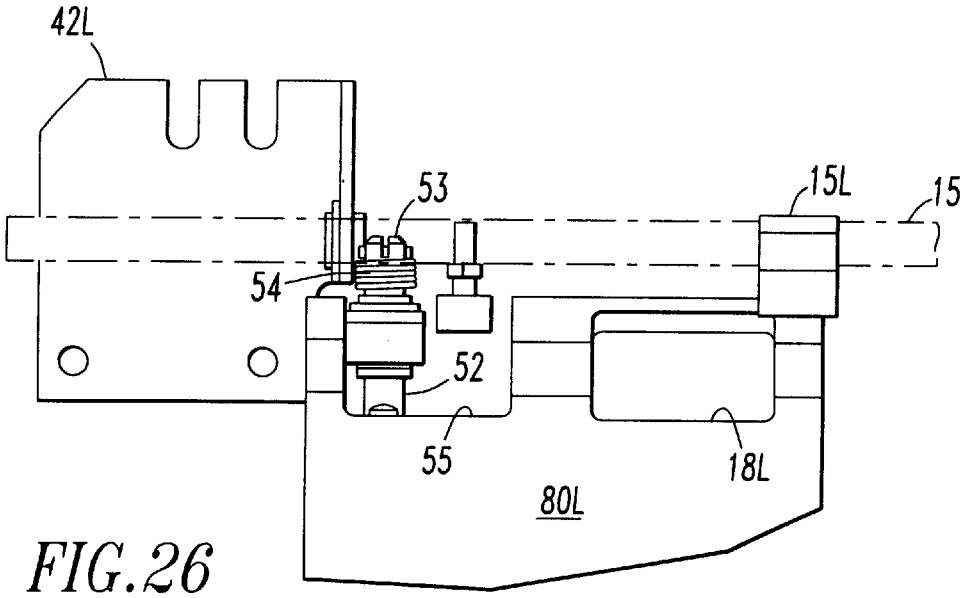
FIG. 26 is a front view of the door lock in condition shown in FIG. 25.
Figure 27:
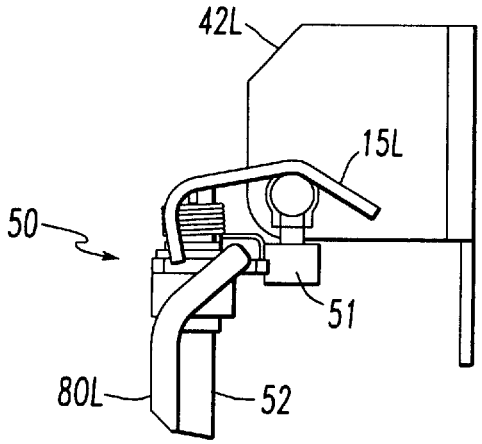
FIG. 27 is a side view of the door lock shown in FIGS. 25 and 26.

FIGS. 25, 26 and 27 illustrate the positions of the locking components 50 and 51 after the left door hanger 80L has moved still further in the opening direction 71. In these figures, lock cam 62 has cleared the lock roller 51. Helical spring 54 has returned lock cam 62 to the position it had in FIGS. 7, 8 and 9. In these figures, the locking components 50 and 51 are fully reset.

Door panels 3L and 3R may then be moved in their closing directions (72 for door panel 3L and 71 for door panel 3R) and the locking cycle illustrated in FIGS. 7 through 15 may be repeated.

Emergency unlocking of door panels 3L and 3R is provided by an emergency release assembly, generally designated 40, which is best seen in FIGS. 2 and 3. Release assembly 40 includes release lever 47 which is attached to lock shaft 15. A pin 48 is attached to release lever 47 so that release lever 47 may be moved by either in car release arm 44 or outside release arm 45. In car release arm 44 is attached to inside pull cable 46 to be activated by persons inside transit vehicle 70. Outside release arm 45 is attached to outside pull cable 49 to be used by persons outside of transit vehicle 70. When either inside pull cable 46 or outside pull cable 49 is pulled, release lever 47 is moved and it rotates lock shaft 15 to the unlocking position shown in FIG. 2. In car release arm 44 and outside release arm 45 operate independently and are returned to and maintained in their non-actuated portions by torsion springs 49.

While a presently preferred embodiment of the instant invention has been described in detail above in accordance the patent statutes, it should be recognized that various other modifications and adaptations of the invention may be made by those persons who are skilled in the relevant art without departing from either the spirit of the invention or the scope of the appended claims.

We claim:

1. A door operator for opening, closing and locking at least one door panel on a transit vehicle, said door operator comprising:

(a) at least one base portion for mounting on the transit vehicle;

(b) at least one fixed door support member attached to said at least one base portion;

(c) at least one door hanger for attachment of the at least one door panel to said fixed door support member;

(d) at least one moveable door support member attached to said at least one door hanger, said at least one moveable door support member engaging said at least one fixed door support member to support said at least one door panel while permitting motion of said at least one door panel in an opening direction of said at least one door panel and in a closing direction of said at least one door panel;

(e) at least one door drive having at least one base mounted door drive portion mounted on said at least one base portion and at least one hanger mounted door drive portion attached to said at least one door hanger, said at least one hanger mounted door drive portion engaging said at least one base mounted door drive portion to be moved thereby to cause the motion of said at least one door panel in the opening direction and in the closing direction of said at least one door panel; and (f) a lock for securing said at least one door panel in a closed position of said at least one door panel, said lock having a lock shaft substantially parallel to said base mounted door drive portion, said locking including at least one primary lock means for preventing motion of said at least one base mounted door drive portion and at least one secondary lock means, said at least one secondary lock means engaging said at least one door hanger to prevent motion of said at least one door hanger, said lock including a lock roller mounted on said lock shaft to rotate said lock shaft about its longitudinal axis from an unlocking position to a locking position when engaged by means for rotating said lock shaft adapted to be disposed on said at least one door panel as said at least one door panel is moved into said closed position of said at least one door panel, said rotation of said lock shaft into said locking position activates said primary and secondary lock means, said lock further including an unlocking actuator for unlocking said at least one door panel, said unlocking actuator having a moveable portion connected to said lock shaft to rotate said lock shaft to said unlocking position of said lock shaft.

2. A door operator, according to claim 1, wherein said base mounted door drive portion includes at least one helical drive member attached to said at least one base portion and said at least one hanger mounted door drive portion includes at least one drive nut connected to said at least one door hanger.

3. A door operator, according to claim 2, wherein said at least one primary lock means is a ratchet pawl for engaging a ratchet wheel attached to said helical drive member to prevent rotation of said helical drive member when said lock shaft is in said locking position.

4. A door operator, according to claim 1, further including a bistable biasing means for retaining said lock shaft in said unlocking position when the door panel is unlocked and in said locking position when the door panel is locked.

5. A door operator, according to claim 1, wherein said lock shaft is biased toward said locking position by gravity.

6. A door operator, according to claim 1, wherein said secondary lock means includes at least one lock pawl, said at least one lock pawl engaging said at least one door hanger to prevent movement of said at least one door hanger when said lock shaft is in said locking position.

7. A door operator, according to claim 6, wherein said at least one door hanger has at least one aperture for receiving said lock pawl.

8. A door operator, according to claim 1, wherein said means for rotating said lock shaft includes at least one lock cam attached to said door hanger.

9. A door operator, according to claim 8, wherein said lock cam is mounted to rotate to permit said lock roller to pass thereby when the door panel moves in the opening direction.

10. A door operator, according to claim 9, further including means for biasing said lock cam into a position for engaging said lock roller.

11. A door operator, according to claim 10, wherein said biasing means includes a helical spring.

12. A door operator, according to claim 1, wherein said unlocking actuator is an electrical actuator.

13. A door operator, according to claim 12, wherein said electrical actuator is a solenoid.

14. A door operator, according to claim 1, further including means for manually rotating said lock shaft from said locking position to said unlocking position so that the door panel may be manually moved in the opening direction.

15. A door operator, according to claim 14, wherein said means for manually rotating said lock shaft includes a pull cable adapted to be accessible from inside the transit vehicle.

16. A door operator, according to claim 14, wherein said means for manually rotating said lock shaft includes a pull cable adapted to be accessible by rescue personnel outside the transit vehicle.

17. A door operator, according to claim 1, wherein said base mounted door drive portion comprises a first helical drive member for the at least one door panel and a second helical drive member for an additional door panel, said first and second helical drive members are connected to one another to rotate in the same direction, said first helical drive member having a pitch which is opposite to a pitch of the second helical drive member whereby the opening and closing directions of the at least one door panel are opposite to opening and closing directions, respectively, of the additional door panel.

18. A door operator, according to claim 17, wherein said helical drive members are joined by a coupler to permit a misalignment therebetween.

* * * * *